US007506736B1

(12) United States Patent
Chen

(10) Patent No.: US 7,506,736 B1
(45) Date of Patent: Mar. 24, 2009

(54) STRUCTURE OF AN EXTENDABLE PULL HANDLE FOR LUGGAGE

(76) Inventor: Shou Mao Chen, No. 344, Sec. 1, Chung Shan Road, Ta Cha Township, Taichung Hsien (TW)

( * ) Notice: Subject to any disclaimer, the term of this patent is extended or adjusted under 35 U.S.C. 154(b) by 685 days.

(21) Appl. No.: 11/175,246

(22) Filed: Jul. 7, 2005

(51) Int. Cl.
*B65D 13/00* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS 6,338,586 B1 * 1/2002 Kuo ..... 403/109.7
6,357,080 B1 * 3/2002 Tsai ..... 16/113.1
6,827,186 B1 * 12/2004 Hsie ..... 190/115
7,207,085 B1 * 4/2007 Chen ..... 16/113.1

* cited by examiner

*Primary Examiner*—Tri M Mai
(74) *Attorney, Agent, or Firm*—Egbert Law Offices PLLC

(57) ABSTRACT

The extendable pull handle for luggage includes several hollow tubes, and the fixed components are placed at the base frame of the hollow tubes of the pull handle. At both sides of hollow tube facing externally, there are separately provided with an upper fixation hole and a lower fixation hole. The component set includes two sets of snapper and a big and small springs; the exterior of first snapper is fitted with the first protruding column, which is protruded and locked onto upper fixation hole of external hollow tube. And, an oblique guide plane is provided at the middle top of first snapper, and a concave surface, at which center and protruded inward is a limit column; the exterior of the second snapper is fitted with a second protruding column, which is protruded and locked onto upper fixation hole of external hollow tube.

1 Claim, 8 Drawing Sheets

STRUCTURE OF AN EXTENDABLE PULL HANDLE FOR LUGGAGE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to luggage, and more particularly to an innovative luggage designed with an extendable pull handle.

BACKGROUND OF THE INVENTION

The conventional pull handles of luggage are designed with a flexible structure, whereby the users can adjust them if necessary. The present invention is intended to improve a flexible structure for a wide array of pull handles of luggage, which lacks of smoothness and accuracy for locking and release of fixation columns (knobs), in despite of continuous development and innovation efforts by relevant operators in this industry. Since the so-called fixation column generally takes flexible components as its braking elements, mutual interference of acting force will likely occur in the case of two flexible components. This will lead to unsmooth operation during flexible positioning of pull handle, and repetitive pulling shall be required for a successful fixation, therefore affecting the value of product with inconvenience of operation.

Thus, to overcome the aforementioned problems of the prior art extendable pull handle of luggage, it would be an advancement in the art to provide an improved pull handle of luggage with an innovative structure.

BRIEF SUMMARY OF THE INVENTION

1. The present invention uses the new features of the first and second snapper 40 50, and the separation of the guide slide plate 52 of the second snapper and the connection between the limit column 44 and the pointing slot 53; with the coordination between two sets of spring 60 70, which has one on the outside and one on the inside to avoid interruption, so that the movement of the locking position can be done as predicted, and make the process smoother, and reduce the breakdown rate and error rate.

2. The present invention also uses the structural design where the internal end of the first and second spring pushing against the second snapper and base frame, so that when the hollow tubes of the pull handle are contracted to press the spring, the pressure can be shared among different parts of the structure to prevent local damages, and it may extend the life of the entire pull handle.

DETAILED DESCRIPTION OF THE INVENTION

Figure 1:
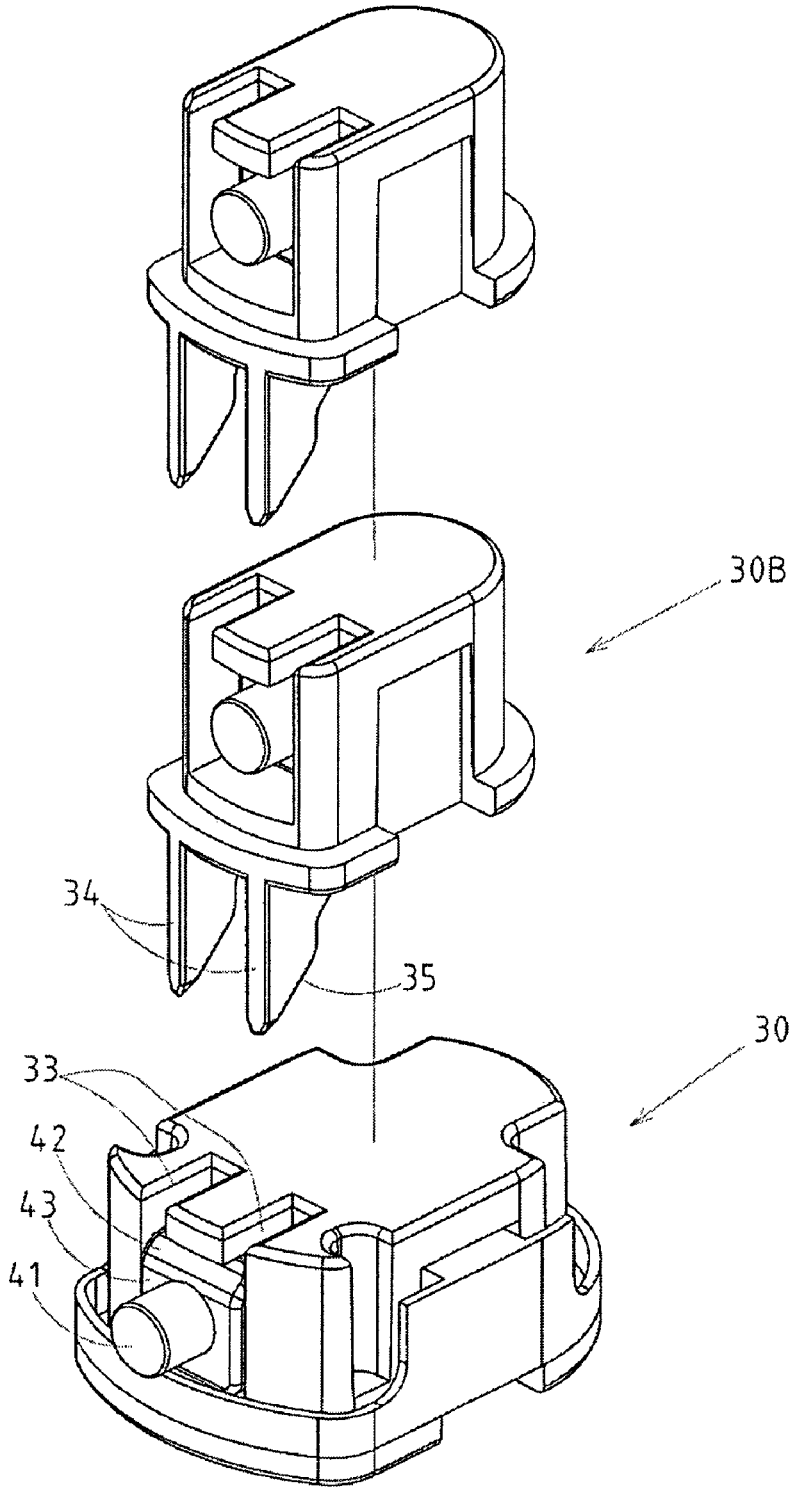
FIG. 1 shows an exploded perspective view of local components of the present invention.

The features and the advantages of the present invention will be more readily understood upon a thoughtful deliberation of the following detailed description of a preferred embodiment of the present invention with reference to the accompanying drawings.

As shown in FIGS. 1-4, there is an extendable pull handle for luggage embodied in the present invention.

The invention includes a pull handle A, which is formed by several hollow tubes through internal and external pin joints. The base frame 30 of hollow tubes 10 20 is provided with an actuating slot 31, wherein some fixation members are placed; at both sides of hollow tube 20 facing externally there are separately provided with an upper fixation hole 21 and a lower fixation hole 22. As the said hollow tube 10 is extended, it can be locked onto upper fixation hole 21 of external hollow tube 20 via the fixation member; as the said hollow tube 10 is contracted, it can be locked onto lower fixation hole 22 of external hollow tube 20 via the fixation member; the fixation member comprises two snapper and two springs.

The exterior of first snapper 40 is fitted with the first protruding column 41, which is protruded and locked onto upper fixation hole 21 of external hollow tube 20; an oblique guide plane 42 is provided at the middle top of first snapper 40, and a concave surface 43, at which center and protruded inward is a limit column 44, which is designed with a T-shaped cylinder.

The exterior of the second snapper 50 is fitted with a second protruding column 51, which is protruded and locked onto the upper fixation hole 22 of external hollow tube 20; and, on the inner end of the second snapper 50 is the guide slide plate 52 that can be connected to the actuating slot 31 of the base frame 30; at the center of the top of the guide slide plate 52 is a pointing slot 53 that can be connected to the limit column 44 of the first snapper 40, and the limit column 44 can slide inside the pointing slot 52 for a designated distance without coming loose.

The first spring 60 is to be placed on the outside of the limit column 44 of the first snapper 40, and between the internal surface 43 of the first snapper 40 and the external surface 54 of the guide slide pate 52 of the second snapper 50.

The second spring 70 is to be placed on the outside of the first spring 60, and its external side is pushed against the internal surface 43 of the first snapper 40, and its internal side is pushed against the limit edge 310 preset inside the actuating slot 31 of the base frame 30.

Figure 2:
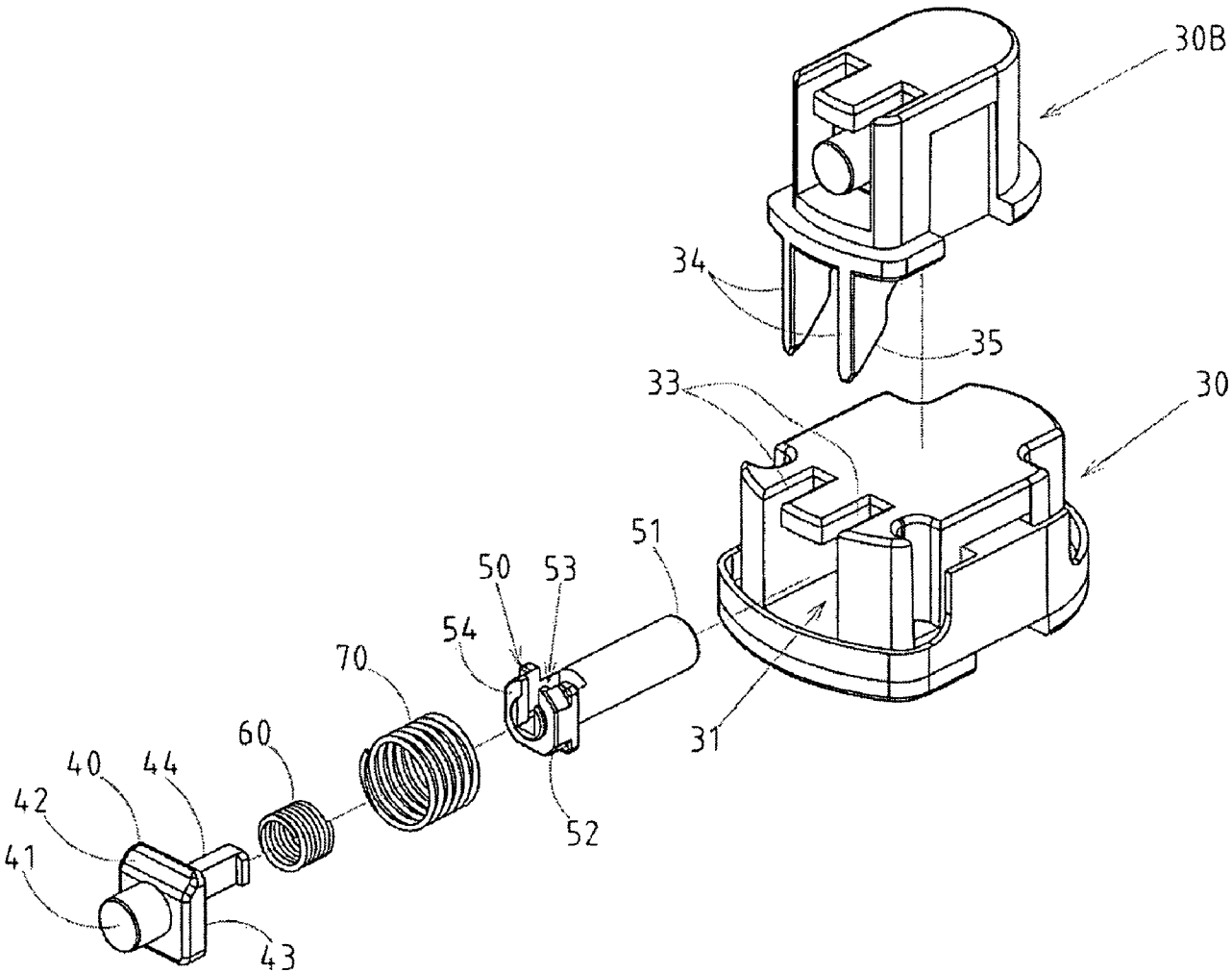
FIG. 2 shows an exploded perspective view of the fixed component inside a base frame.

A through hole 33 is opened into the oblique guide plane 42 of first snapper 40 opposite to the top of actuating slot 31 of hollow tube 10's base frame 30, such that base frame 30B bottom of another upper hollow tube is provided with convex leg 34 (as shown in FIG. 2) opposite to said through hole 33; an oblique edge 35 is mounted onto the bottom of the convex leg 34.

Based upon the aforementioned structure and composition, the innovative pull handle of luggage with a flexible structure can function as detailed below:

The pull handle of the present invention offers the same operating characteristics (extendable and contractible) as that of general pull handle of luggage. The major features of the present invention lie in the fixation structure.

Figure 3:
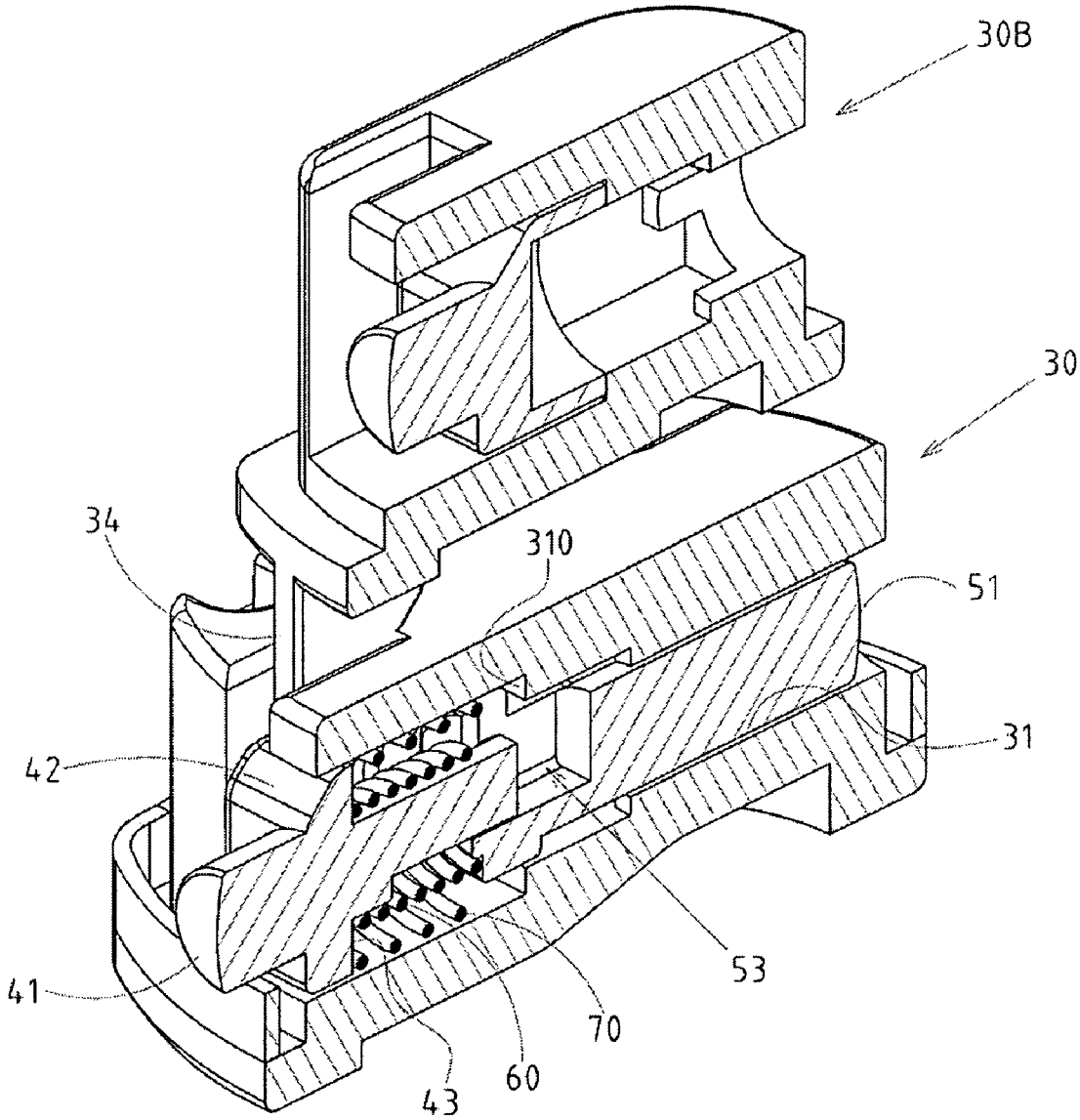
FIG. 3 shows a perspective and sectional view of the fixed component of the base frame.
Figure 4:
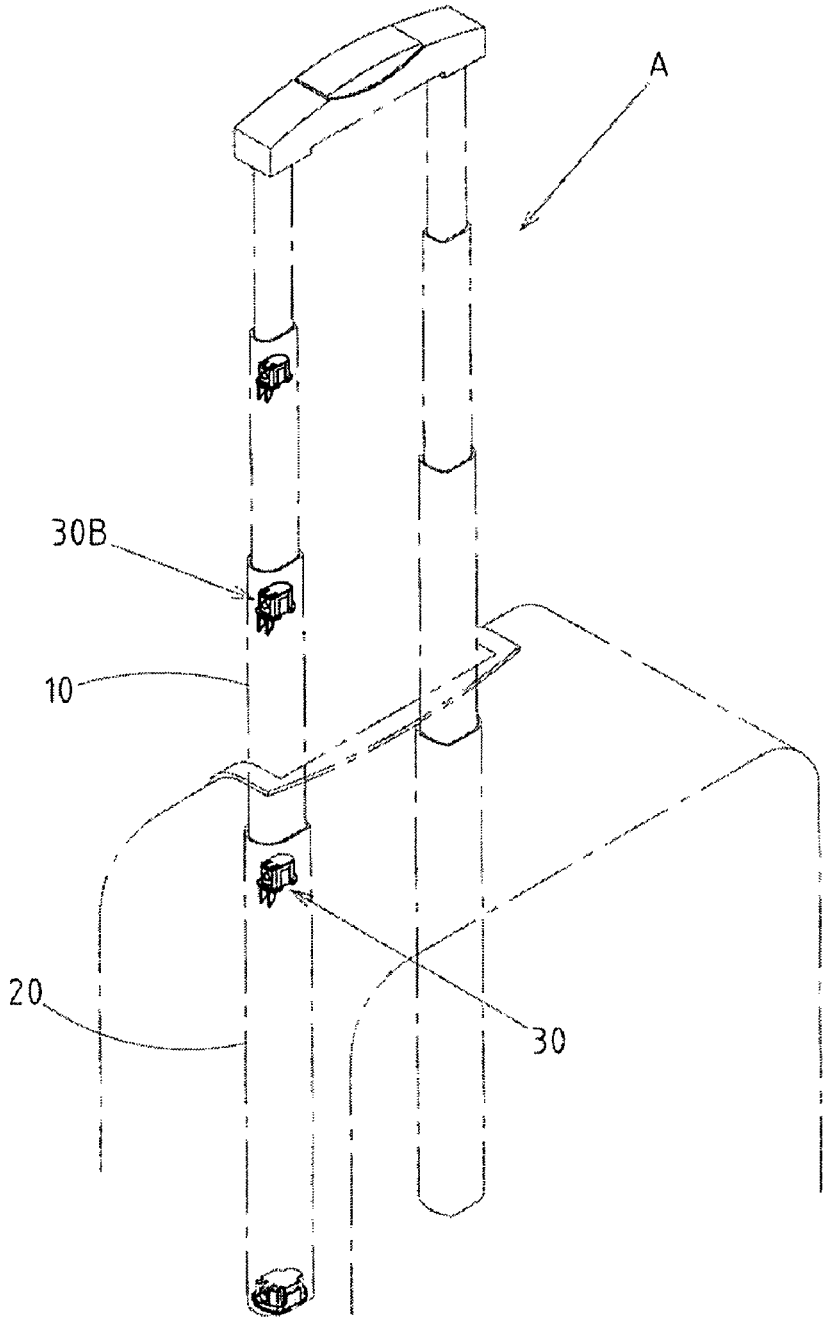
FIG. 4 shows a transparent perspective view of the location of the hollow tube of the pull handle on the base frame.
Figure 5:
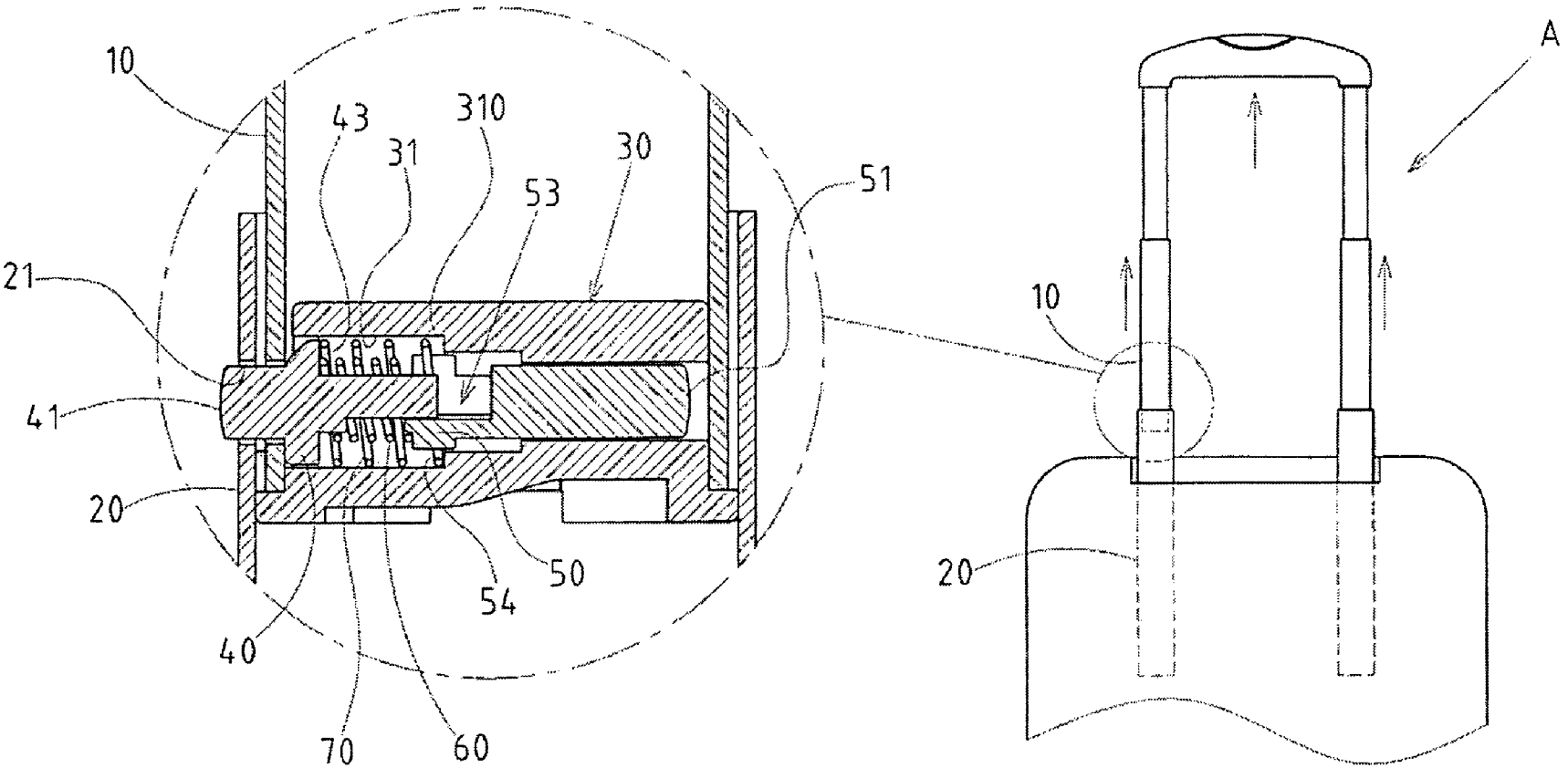
FIG. 5 shows an elevation view of the pull handle when it is extended and a vertical sectional view of its inside.
Figure 6:
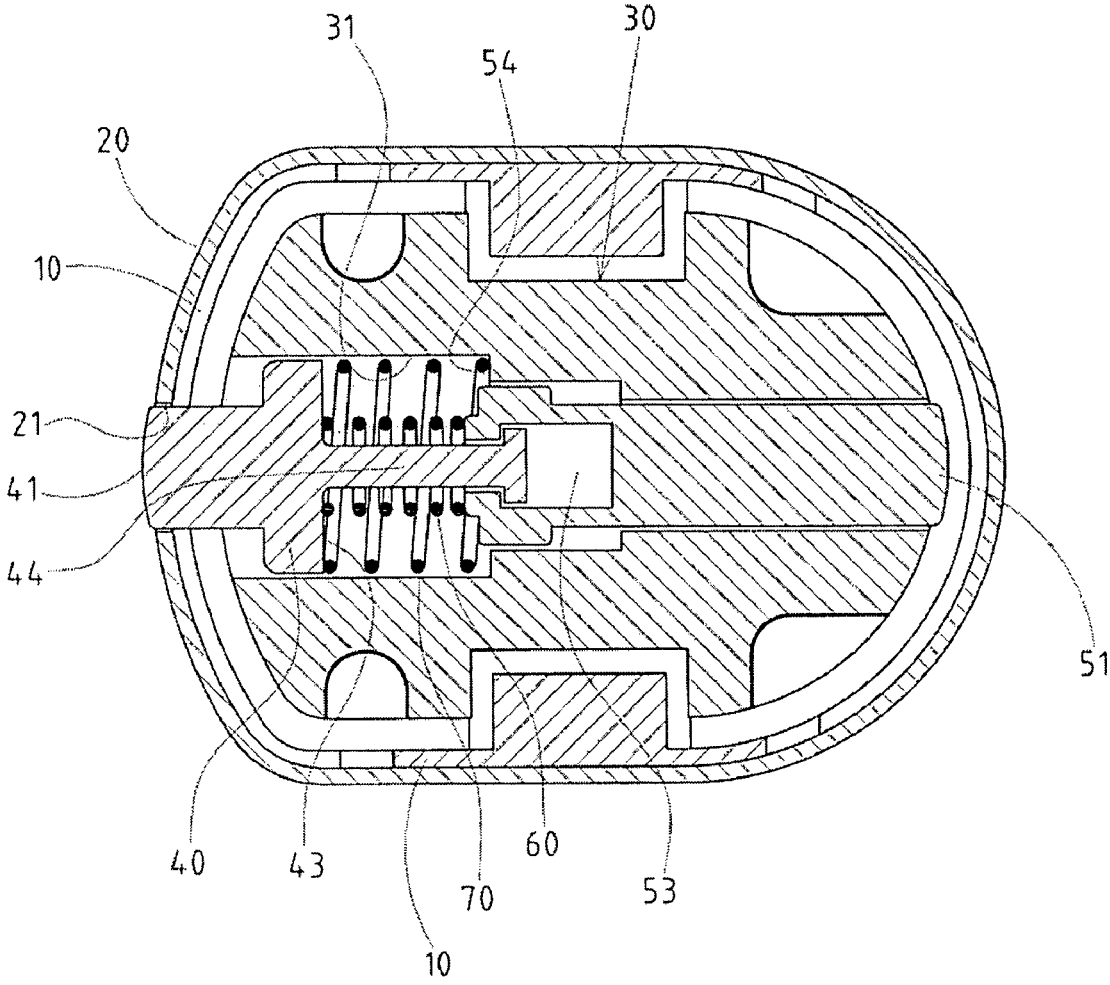
FIG. 6 shows a corresponding view of FIG. 5, as a horizontal sectional view of the fixed components.

FIGS. 3, 4, and 5 show the condition when the pull handle A is extended. Under the circumstances where the internal hollow tube 10 is extended upward to a stopped position, because the fixation hole 21 on another side of wall at the top of the external hollow tube 20 is setting correspondingly to the first protruding column 41 on the first snapper 40, therefore it can protrude outward by the spring function of the second spring 70, and lock onto the fixation hole 21 on the external hollow tube 20, so that the pull handle A can be extended to reached the desired position.

Figure 7:
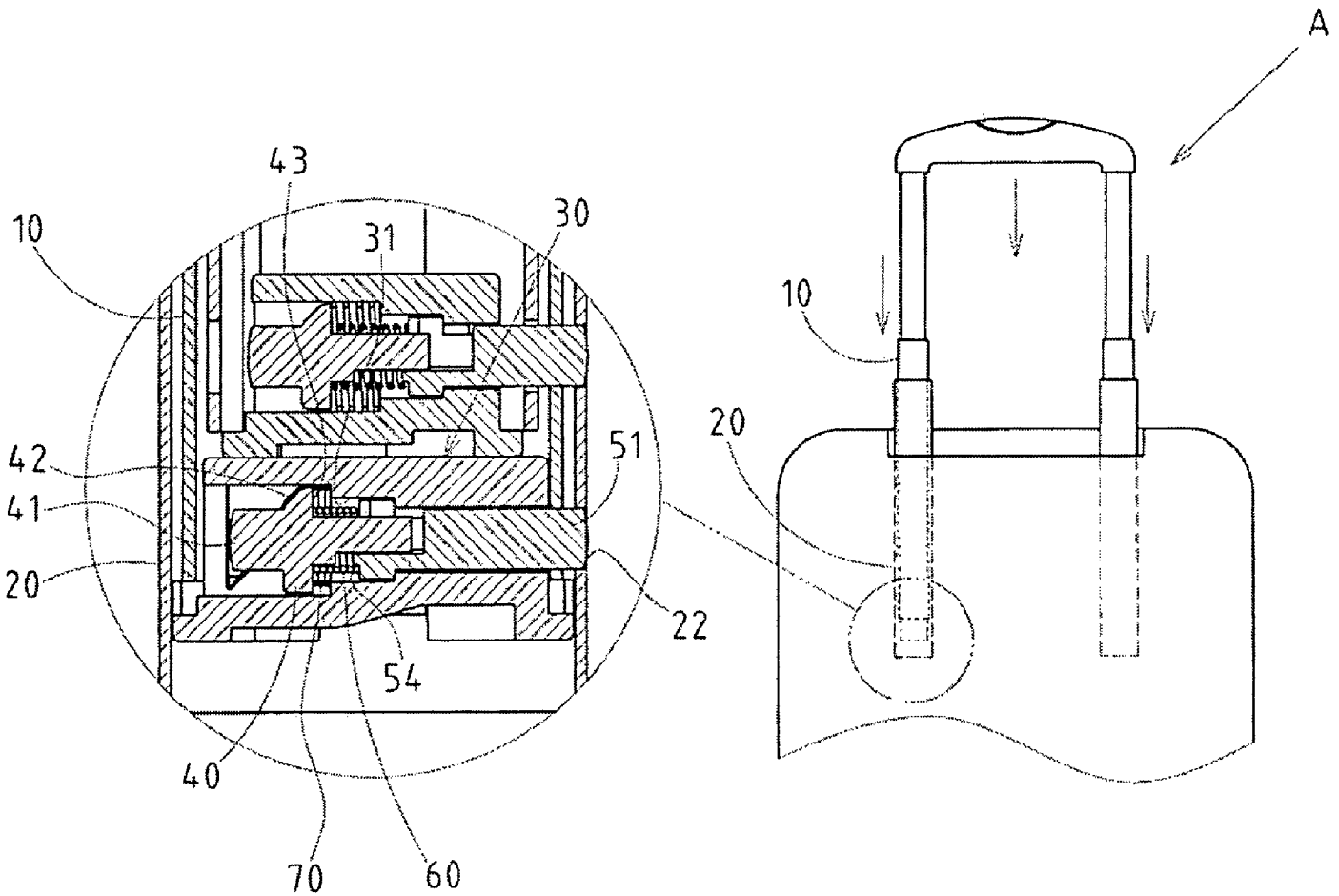
FIG. 7 shows an elevation view of the pull handle when it is contracted and a vertical sectional view of its inside.
Figure 8:
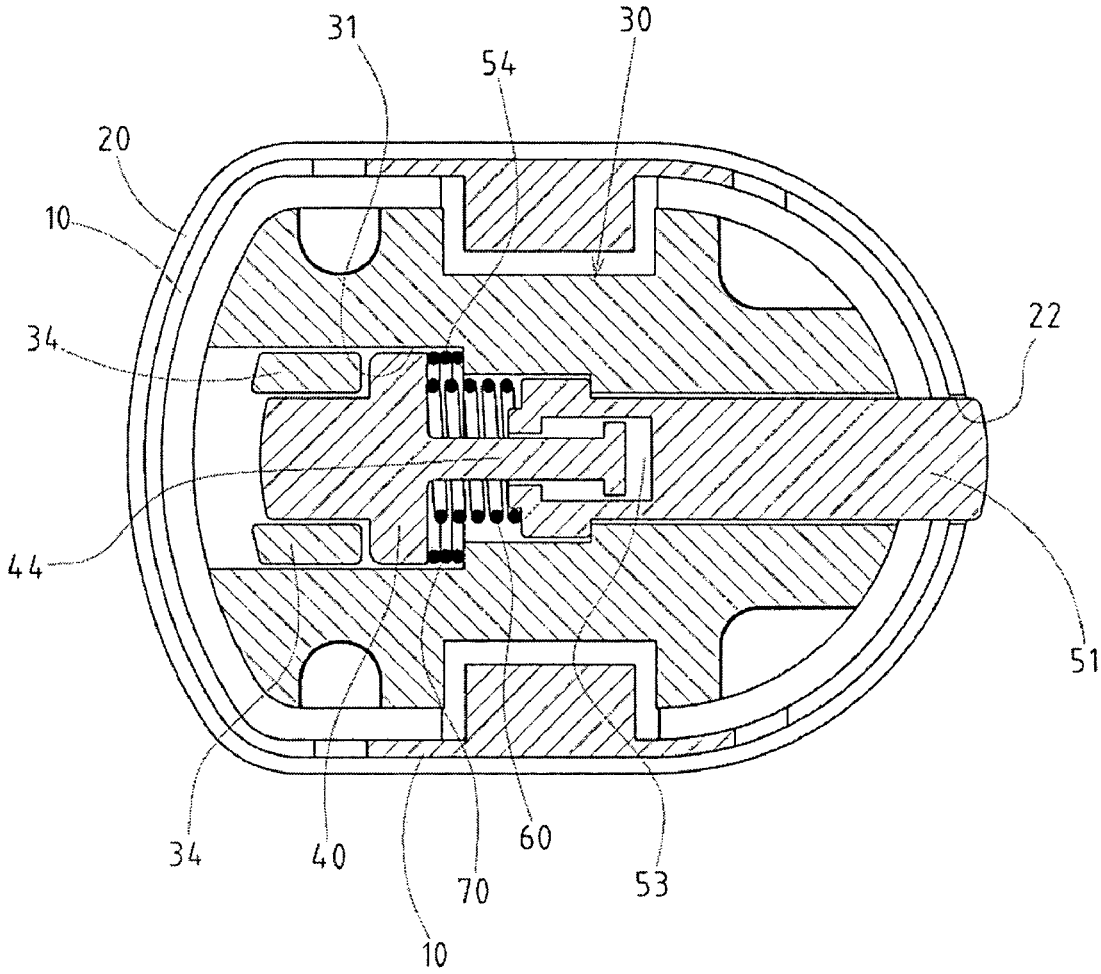
FIG. 8 shows a corresponding view of FIG. 7, as a horizontal sectional view of the fixed components.

As shown in FIGS. 7 and 8, when the hollow tubes 10 20 of the pull handle A is contracted, the convex leg 34 of the base frame 30B located in the internal hollow tube 10 will go through the bottom (which is the through hole 33 of the base frame 30 on the external hollow tube) (see FIG. 2), and by pushing the oblique edge 35 against the oblique guide plane 42 to make the first snapper 40 slide towards the second snapper 50, and at the same time, it pushes the first spring 60 and the second spring 70, and among them, the internal end of the second spring creates pushing force on the limit edge 310 of the base frame 30, and the first spring 60 creates pushing force on the second snapper 50, therefore, when the internal hollow tube 20 descends to a stopped position because the second protruding column 51 of the second snapper 50 is setting correspondingly to the fixation hole 22 of the external hollow tube 20, so that the spring force accumulated from the first spring 60 may be released, and cause the second snapper 50 sliding out by the force of the second protruding column 51 and making the second protruding column 51 lock onto the lower fixation hole 22 on the external hollow tube 20, and making the pull handle A contract to reach the desired position.

I claim:

1. An expandable pull handle for luggage comprising:

at least a pair of hollow tubes mounted together in telescopic relation, each of the hollow tubes having an upper fixation hole and a lower fixation hole;

a base frame for the hollow tubes, said base frame having an actuating slot;

a fixation member positioned in said actuating slot of said base frame, said fixation member suitable for engaging said upper fixation hole so as to lock one of the hollow tubes relative to another of the hollow tubes when the hollow tubes are extended and suitable for engaging said lower fixation hole so as to lock one of the hollow tubes relative to another of the hollow tubes when the hollow tubes are retracted, said fixation member comprising a first snapper and a second snapper and a first spring and a second spring, said first snapper being fitted with a first protruding column, said first protruding column extending so as to lock with said upper fixation hole, said first snapper having an oblique guide plane at a top thereof, said fist snapper having a concave surface and a limit column protruding inwardly at a center of said concave surface, said limit column being of a T-shaped cylinder, said second snapper having a second protruding column extending so as to lock with said upper fixation hole, said second snapper having a guide slide plate on an inner end thereof, said guide slide plate connected to said actuating slot of said base frame, said guide slide plate having a pointing slot at a center of a top thereof, said pointing slot connected to said limit column of said first snapper, said limit column being slidable in said pointing slot, said first spring positioned on an outside of said limit column of said first snapper, said first spring extending between an internal surface of said first snapper and an external surface of said guide slide plate of said second snapper, said second spring positioned on an exterior of said first spring, said second spring having an external side urging against said internal surface of said first snapper, said second spring having an internal side urging against a limit edge formed inside said actuating slot of said base frame, said oblique guide plane of said first snapper having a through hole extending to a top of said actuating slot, said base frame having a bottom having a convex leg opposite to said through hole, said convex leg having an oblique edge mounted at a bottom thereof, said first snapper slidable toward said second snapper by pushing said oblique edge against said oblique guide plane such that said first protruding column releases from the fixation hole.

* * * * *